United States Patent [19]

Campau

[11] Patent Number: 4,532,962

[45] Date of Patent: Aug. 6, 1985

[54] METERING APPARATUS FOR DISPENSING PRECISE VOLUMES OF LIQUID

[76] Inventor: Daniel N. Campau, 656 Duxbury Crt., SE., Grand Rapids, Mich. 49506

[21] Appl. No.: 602,383

[22] Filed: Apr. 20, 1984

[51] Int. Cl.[3] ..... F15C 1/118

[52] U.S. Cl. ..... 137/842; 137/565; 137/624.11; 222/639

[58] Field of Search ..... 137/842, 804, 805, 841, 137/624.11, 565; 222/639, 335

[56] References Cited

U.S. PATENT DOCUMENTS

| | | | |
|---|---|---|---|
| Re. 29,715 | 8/1978 | Richards | 141/226 |
| 3,533,373 | 10/1970 | King | 137/842 |
| 3,703,907 | 11/1972 | Richards | 137/386 |
| 4,148,334 | 4/1979 | Richards | 137/389 |
| 4,211,249 | 7/1980 | Richards | 137/393 |
| 4,298,024 | 11/1981 | McLeod | 222/639 |
| 4,484,601 | 11/1984 | Campau | 137/805 |

*Primary Examiner*—A. Michael Chambers
*Attorney, Agent, or Firm*—Niro, Scavone, Haller & Niro

[57] ABSTRACT

An apparatus is disclosed for dispensing a precise volume of liquid. An emitter dispenses a stream of liquid to an appropriate collector and includes an outlet restriction for generating a positive pressure in the emitter behind the outlet restriction. Liquid is fed to the emitter under pressure. A time delay loop is provided in communication with the emitter behind the outlet restriction for receiving liquid therefrom under the influence of the positive pressure. The exit end of the time delay loop directs liquid received thereby against the stream of liquid dispensed by the emitter and diverts the stream of liquid away from the collector when the time delay loop becomes filled with liquid under pressure from the emitter. A fluid amplifier is provided for generating a laminar liquid power stream to the emitter and for controlling the on-off cycle of the apparatus.

25 Claims, 3 Drawing Figures

METERING APPARATUS FOR DISPENSING PRECISE VOLUMES OF LIQUID

BACKGROUND OF THE INVENTION

The present invention relates generally to fluid metering devices and, more particularly, to an apparatus for dispensing a precise volume of liquid by fluidic means.

Devices have been known for dispensing a precise or metered volume of liquid in a pulsated or periodic manner. Various apparatus, such as positive displacement pumps, have been employed to dispense metered volumes of liquid for various purposes. Such apparatus are capable of selective operation or operation by pulsations or cyclical controls. One of the problems with prior apparatus of the character described is in maintaining the precision of the devices due to wear or manufacturing tolerances in the various moving components of the apparatus. For instance, pistons and cylinders and their operative components become worn and adversely affect maintenance of precise volume dispensing. Seals are required for such devices and those components become worn as well. Manufacturing tolerances for all of the components of such apparatus is a constant problem requiring cost extensive quality controls.

Another problem with prior apparatus for dispensing metered volumes of liquid is that they often are affected by changes in pressure, viscosity or temperature influences on or in the liquid being dispensed. The prior apparatus may be preset to dispense accurate metered volumes of liquid, but pressure, viscosity or temperature changes can upset the preset or calibrated conditions of the apparatus.

The present invention is designed to overcome these problems by providing an apparatus for dispensing a precise volume of liquid by accurate metered controls which are totally independent of such changes in pressure, viscosity or temperature. This is accomplished by employing total fluidic controls which have no moving parts and which employ a fluid amplifier within the controls.

SUMMARY OF THE INVENTION

An object, therefore, of the present invention is to provide an apparatus for dispensing a precise volume of liquid in accurate, preset metered amounts.

Another object of the invention is to provide an apparatus of the character described which is independent of any changes in pressure, viscosity or temperature in or on the dispensed liquid.

In the exemplary embodiment of the invention, the apparatus includes emitter means for dispensing a stream of liquid to an appropriate collector. The emitter means includes outlet restriction means for generating a positive pressure in the emitter means behind the outlet restriction means. Supply means feeds liquid under pressure to the emitter means. Time delay conduit means, such as a time delay loop, is provided in communication with the emitter means behind the outlet restriction means for receiving liquid therefrom under the influence of the positive pressure. The time delay conduit means terminates in an outlet for directing liquid against the stream of liquid dispensed by the emitter means and diverting the stream of liquid away from the collector when the time delay conduit means becomes filled with liquid under pressure from the emitter means. Preferably, inlet restriction means is provided at the entrance of the time delay loop from the emitter means.

Thus, with the apparatus described above, the volume dispensed is a function only of the parameters of the device involving the time delay loop. The controlling factors or parameters simply are the length of the time delay loop, its cross sectional dimensions and the ratio between the outlet restriction means of the emitter means and the inlet restriction means of the time delay loop. Pressure, viscosity or temperature of the dispensed liquid are not factors and, consequently, cannot affect the precise metering of the apparatus.

In order to further control the apparatus solely by fluidic means, the supply means includes a fluid amplifier in liquid communication with the emitter for generating a laminar liquid power stream thereto. The fluid amplifier includes an access region to the liquid power stream and control means communicating with the access region. Ambient pressure at the access region maintains the laminar flow of the liquid power stream. However, when air is cut off to the access region, or diverting liquid is admitted thereto, the laminar liquid power stream is converted to a substantially turbulent flow pattern which disrupts the pressure generating ability of the fluid amplifier and thereby creates an aspiration at the emitter means to stop dispensing liquid therefrom. Aspiration at the emitter means generates a negative pressure in the time delay loop whereby the loop drains preparatory to a successive dispensing cycle. Preferably, a second fluid amplifier is employed to more positively control the on-off cycle of the first fluid amplifier.

The apparatus is disclosed in the form of a completely closed device including a closed reservoir for collecting the liquid directed from the line delay loop and the liquid diverted from the emitter after a metered volume of liquid has been dispensed. A control port to the closed reservoir permits the application of pressure thereto as well as a blanket of specified gas for purposes described hereinafter.

Other features of the apparatus include restriction means at the outlet of the time delay loop for generating a jet of liquid directed against the stream of liquid dispensed from the emitter for more positively diverting the stream away from the collector. Trap means also is provided in the time delay loop for capturing any air entrapped in the loop.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
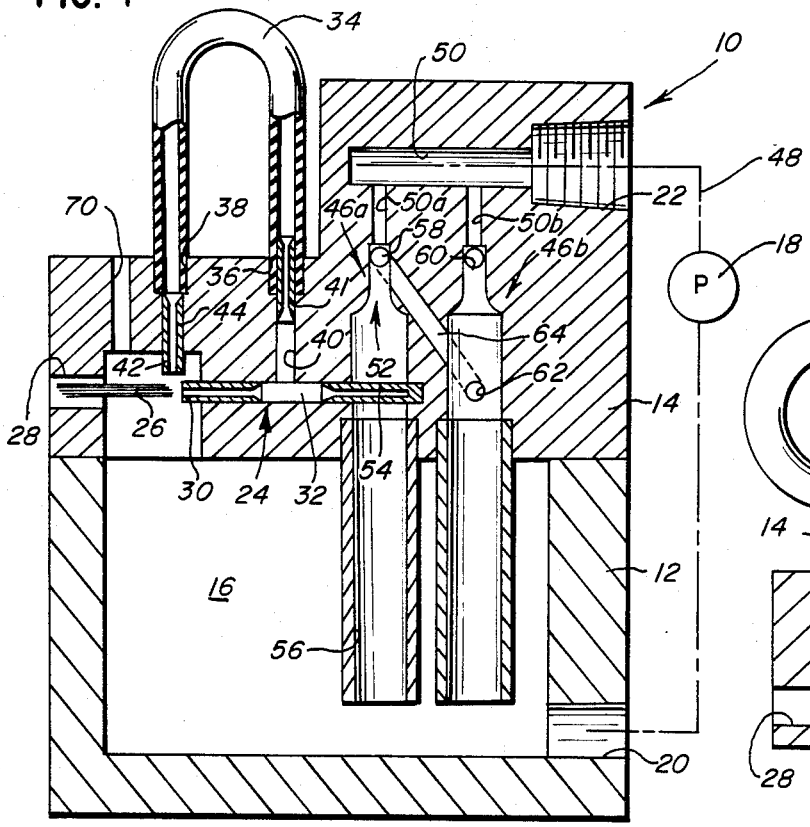
FIG. 1 is a somewhat schematic view of the dispensing apparatus of the invention, employing two fluid amplifiers.

Referring to the drawings in greater detail, and first to FIG. 1, an apparatus, generally designated 10, is disclosed for dispensing a precise or metered volume of liquid. The apparatus includes a housing comprising a lower housing block 12 and an upper housing block 14 which are substantially solid and define a reservoir 16 in the lower housing block. A pump 18 is provided for drawing liquid from reservoir 16 through an outlet 20 in lower housing block 12 and feeding the liquid under pressure to an inlet 22 in upper housing block 14.

Apparatus 10 includes emitter means, generally designated 24, for dispensing a stream of liquid 26 through a collector opening 28 to an appropriate collector (not shown). The collector may comprise a syringe, for instance, to which a precise, metered volume of liquid is to be dispensed. Medical applications are but one of a wide variety of uses for which the apparatus of the invention is applicable.

Emitter 24 has an outlet restriction means 30 for generating a positive pressure in an enlarged area 32 behind the outlet restriction means.

Time delay conduit means in the form of a time delay loop 34 is provided in communication with emitter means 24 in the area 32 behind emitter outlet restriction means 30 for receiving liquid therefrom under the influence of the positive pressure generated by the restriction means. More particularly, time delay loop 34 may comprise a flexible loop having an entrance end seated within a bore 36 in upper housing block 14, and an exit end received in a bore 38 in the upper housing block. A reduced diameter bore 40 is formed in the upper housing block in communication with emitter 24 and for receiving an inlet restriction means 41 at the entrance to time delay loop 34. Preferably, a restriction means 42 is provided in another reduced diameter bore 44 in the upper housing block for generating a jet of liquid to be directed against the stream of liquid 26 dispensed by emitter 24, as described hereinafter.

In operation, time delay loop 34 is positioned for receiving liquid from emitter 24 and directing the liquid received thereby against the stream of liquid 26 and diverting the stream of liquid away from collector opening 28 and an appropriate collector at a time when the time delay loop becomes filled with liquid under pressure from the emitter. In other words, emitter 24 will dispense liquid for a predetermind period of time which is dependent upon the time necessary for filling the time delay loop. Filling the loop immediately results in a jet of liquid being directed against the stream of liquid dispensed from the emitter and directing the stream away from collector opening 28. As will be developed in greater detail hereinafter, it is readily apparent that the volume of liquid dispensed by emitter 24 is dependent only upon the length of time delay loop 34, its interior cross sectional dimensions and the ratio between emitter restriction means 30 and loop restriction means 41. The factor of restriction means 42 at the outlet of time delay loop 34 is practically negligible because of the instantaneous flow therethrough which effects diversion of the stream of liquid 26 dispensed by the emitter.

Control of apparatus 10 is effected by one or more fluid amplifiers, generally designated 46*a* and 46*b*. Each fluid amplifier is of the type disclosed in U.S. application Ser. No. 404,070, filed Aug. 2, 1982, now U.S. Pat. No. 4,484,601 issued Nov. 27, 1984, herein by reference. Generally, a laminar liquid power stream is supplied by pump 18, through a supply line 48 to inlet port 22 of upper housing block 14. From there the laminar liquid power stream is fed through a generally horizontal passage 50 in the upper housing block and downwardly through vertical passages 50*a* and 50*b* to fluid amplifiers 46*a* and 46*b*, respectively. Referring first to fluid amplifier 46*a*, the laminar liquid power stream is directed downwardly through an access region 52. Emitter 24 has a receiver port 54 exposed to the power stream for generating a positive fluid pressure and laminar flow through the emitter. Excess fluid flow passes around port 54 and downwardly through a depending drain tube 56 into reservoir 16. A control port 58 is provided in fluid amplifier 46*a* in communication with access area 52.

As is known from the teachings of U.S. application Ser. No. 404,070, as long as air is admitted through control port 58 to access region 52, a laminar liquid power stream will flow through fluid amplifier 46*a* and supply a jet of liquid through receiver port 54 of emitter 24, whereby this liquid flows out through the emitter as described above. When control port 58 is blocked or liquid is supplied thereto, the laminar liquid power stream through the fluid amplifier will be converted to a substantially turbulent flow pattern which disrupts the pressure generating ability of the fluid amplifier. This creates an aspiration in the emitter as well as in time delay loop 34. As long as control port 58 is blocked, the aspiration will effect draining of liquid from emitter 24 and time delay loop 34, through drain tube 56 into reservoir 16. Removal of the blockage at control port 58 initiates another cycle of operation and another precise or metered dispensing operation as described above.

The control signal provided by blocking and unblocking control port 58 of fluid amplifier 46*a* can be accomplished by various means, including mechanical, electro-mechanical and fluidic. For instance, an electromechanical device may be employed, such as using a solenoid operated mechanism. If apparatus 10 is used to fill syringes or medical vials, the vial could be positioned to actuate a limit switch to operate the solenoid controlled mechanism to open and close control port 58 to switch amplifier 46*a* between its "on" and "off" conditions. In the on condition, control port 58 could simply be vented to atmosphere. Other control mechanisms are readily contemplated.

However, in the preferred embodiment of the invention disclosed herein, second fluid amplifier 46*b* is provided as a second turbulent diverting amplifier. A laminar liquid power stream is fed through passage 50 and downwardly through passage 50*b* to the second fluid amplifier 46*b*. The second fluid amplifier similarly includes a control port 60 and a receiver 62. However, receiver 62 is maintained in communication with control port 58 of first fluid amplifier 46*a* by means of a cross control conduit 64. The second fluid amplifier operates as a turbulent diverting amplifier as described in relation to fluid amplifier 46*a*. In other words, blocking and unblocking control port 60 switches fluid amplifier 46*b* between its "on" and "off" conditions. However, the second fluid amplifier is considerably more precise than mechanical or electrical mechanical means for supplying a control signal to control port 58 of the main fluid amplifier 46*a*. In other words, the second fluid amplifier controls the first fluid amplifer with a liquid signal rather than an air signal. The liquid generates a stronger vacuum in the access region.

Figure 2:
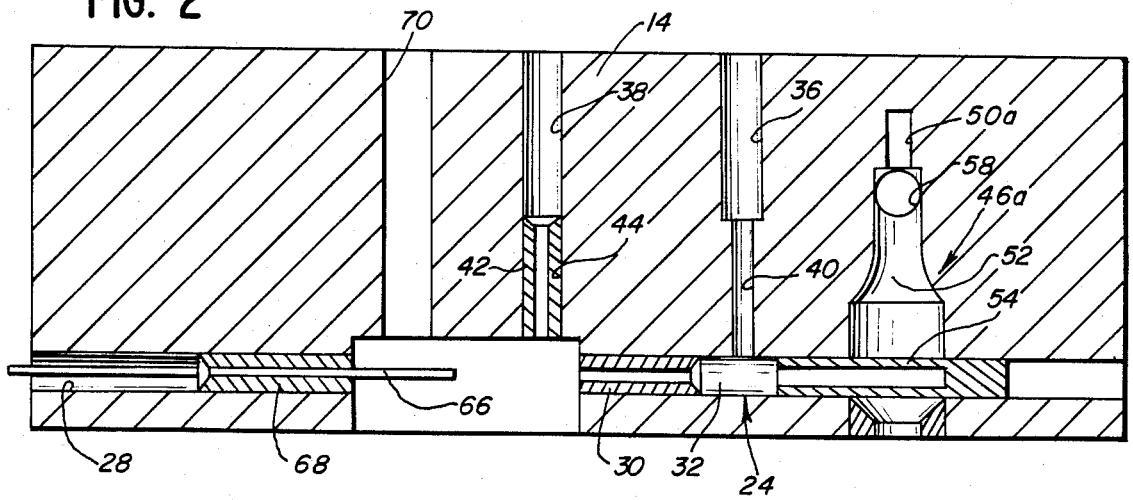
FIG. 2 is a somewhat schematic view of the upper housing block adapted for use with a single fluid amplifier, along with a precision collector tube.

FIG. 2 shows upper housing block 14 adapted for using a single fluid amplifier 46a, along with bores 36–44 for receiving restriction means 41 and 42 of time delay loop 34 (FIG. 1). Emitter 24 is similarly located as in FIG. 1. However, this embodiment illustrates the use of a collector tube 66 for receiving dispensed liquid from emitter 24. A seal 68 surrounds the collector tube and positions the tube within collector opening 28. The collector tube not only provides for more accurate location of the dispensing outlet of the apparatus, but seal 68 facilitates closing reservoir 16 to atmosphere. In particular, an ambient reference control port 70 (also see FIG. 1) is provided in communication with interior reservoir 16 of the housing. It may be desirable to dispense liquid within a blanket of a specified gas (e.g. nitrogen), and control port 70 permits the gas to be supplied to the interior of the housing. Furthermore, collector tube 66 can be of sufficient length to permit metered volumes of liquid to be moved intermittently downstream of the tube. Pressure can be applied through control port 70 into the interior of the housing to effect movement of the liquid downstream of collector tube 66.

Figure 3:
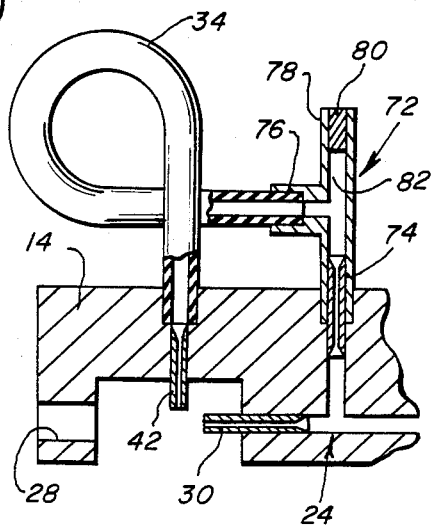
FIG. 3 is a somewhat schematic view of the air trap of the invention employed in the time delay loop.

FIG. 3 illustrates another feature of the invention which includes trap means, generally designated 72, in time delay loop 34 downstream of inlet restriction means 40 at the entrance of the time delay loop. The trap means is provided in the form of a T-shaped fitting which has a downwardly depending leg 74 fitted over inlet restriction means 41, a horizontal leg 76 for receiving the entrance end of time delay loop 34, and an upwardly extending leg 78 which is plugged, as at 80, to define an air trap area 82. Air within time delay loop 34 conceivably could adversely affect the metering function of the time delay loop. However, not only is the air trapped within area 82, but the trapped means dissipates pressure pulses and isolates any turbulence created downstream of restriction means 41.

As stated above, the apparatus of the present invention is totally independent of pressure, viscosity, or temperature variations in the dispensed fluid. The volume of fluid dispensed is a function only of the length of time delay loop 34, its interior cross sectional dimensions, and the ratio of emitter restriction means 30 and loop restriction means 41. This can be seen by the following calculations where:

$K_o$=Emitter restriction.

$K_t$=Time delay loop restriction.

l=Length of the time delay loop between the restriction means at its ends.

D=Inside diameter of the time delay loop.

P=Pressure in the emitter behind its restriction means.

$Q_t$=Flow rate in the time delay loop.

$Q_o$=Flow rate out of the emitter.

The time delay loop volume ($V_t$) is calculated as follows:

$$V_t=\pi/4D^2l.$$

The time ($\Delta_t$) to fill the time delay loop is calculated as follows:

$$Q_t = K_t\sqrt{P}$$

-continued $$V_t = \Delta_t Q_t = \frac{\pi}{4} D^2 l$$

$$\Delta_t = \frac{\pi}{4} \frac{D^2 l}{K_t\sqrt{P}}$$

The volume ($V_o$) dispensed in time $\Delta_t$ is calculated as follows:

$$Q_o = K_o\sqrt{P}$$

$$V_o = \Delta_t Q_o = \Delta_t K_o\sqrt{P}$$

The volume dispensed as functions of the apparatus parameters is calculated as follows:

$$V_o = \Delta_t K_o\sqrt{P} \qquad V_o = \left\{ \frac{\pi}{4} \frac{D^2 l}{K_t\sqrt{P}} \right\} K\sqrt{P}$$

$$\Delta_t = \frac{\pi}{4} \frac{D^2 l}{K_t\sqrt{P}} \qquad V_o = \frac{\pi}{4} \frac{D^2 l}{K_t} K_o$$

It can be seen that all pressures in the system, as well as other fluid properties such as temperature or viscosity, drop out of the calculations and the volume dispensed is constant regardless of changes in liquid pressure, temperature, viscosity, etc. The apparatus of the invention acts as a positive displacement device but has no moving parts which could adversely affect the accuracy of the apparatus through wear or manufacturing tolerances. The apparatus can be preset accurately simply by varying the length of a given diameter time delay loop 34 (i.e. "l" and "D"), with constant restriction values. The time delay loop can be fabricated of clear flexible plastic material in varying lengths to calibrate the metered volume desired. It also is contemplated that a telescoped tubular construction could be employed to simply vary the length of the time delay loop for calibration purposes. The fluid amplifiers further enhance the accuracy of the apparatus by maintaining total fluidic control and operation throughout.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An apparatus for dispensing a precise volume of liquid, comprising:

emitter means for dispensing a stream of liquid to an appropriate collector, the emitter means including outlet restriction means for generating a positive pressure in the emitter means behind the outlet restriction means;

supply means for feeding liquid under pressure to said emitter means; and time delay conduit means in communication with said emitter means behind said outlet restriction means for receiving liquid therefrom under the influence of said positive pressure, the time delay conduit means being positioned for directing liquid received thereby against the stream of liquid dispensed by the emitter means and diverting the stream of liquid away from said collector when the time delay conduit means becomes filled with liquid under pressure from the emitter means.

2. The apparatus of claim 1, including reservoir means for collecting the liquid directed from said time delay conduit means and the liquid diverted from said emitter means.

3. The apparatus of claim 2 wherein said supply means includes means for drawing liquid from said reservoir means.

4. The apparatus of claim 2 including means for draining liquid from said emitter means and said time delay conduit means into said reservoir.

5. The apparatus of claim 1, including inlet restriction means at the entrance of said time delay conduit means.

6. The apparatus of claim 1, including restriction means at the outlet of said time delay conduit means for generating a jet of liquid against the stream of liquid dispensed by the emitter means.

7. The apparatus of claim 1, including trap means in said time delay conduit means for capturing any air entrapped in the conduit means.

8. The apparatus of claim 1 wherein said supply means includes means for pulsating the feeding of liquid under pressure to said emitter means.

9. The apparatus of claim 8, including means for draining liquid from said time delay conduit means between pulsations of liquid to said emitter means.

10. The apparatus of claim 1 wherein said supply means includes fluid amplifier means in liquid communication with said emitter means for generating a laminar liquid power stream thereto.

11. The apparatus of claim 10 wherein said fluid amplifier means includes an access region to said liquid power stream, and including control means communicating with said access region for converting said laminar liquid power stream to a substantially turbulent flow pattern which disrupts the pressure generating ability of the fluid amplifier and thereby creates an aspiration at said emitter means to stop dispensing of liquid therefrom.

12. The apparatus of claim 11 wherein the aspiration at the emitter means generates a negative pressure in said time delay conduit means, and including means for draining liquid from the time delay conduit means and the emitter means.

13. The apparatus of claim 11, including second fluid amplifier means in communication with the control means of said first named fluid amplifier means for controlling the same.

14. An apparatus for dispensing a precise volume of liquid, comprising:

emitter means for dispensing a stream of liquid to an appropriate collector, the emitter means including outlet restriction means for generating a positive pressure in the emitter means behind the outlet restriction means;

fluid passage means communicating with said emitter means;

means for feeding liquid to said fluid passage means to develop a substantially laminar liquid power stream therethrough;

fluid amplifier means in said liquid power stream for generating a positive fluid pressure toward said emitter means; and time delay conduit means in communication with said emitter means behind said outlet restriction means for receiving liquid therefrom under the influence of said positive pressure, the time delay conduit means being positioned for directing liquid received thereby against the stream of liquid dispensed by the emitter means and diverting the stream of liquid away from said collector when the time delay conduit means becomes filled with liquid under pressure from the emitter means.

15. The apparatus of claim 14 wherein said fluid amplifier means includes an access region to said liquid power stream, and including control means communicating with said access region for converting said laminar liquid power stream to a substantially turbulent flow pattern which disrupts the pressure generating ability of the fluid amplifier and thereby creates an aspiration at said emitter means to stop dispensing of liquid therefrom.

16. The apparatus of claim 15 wherein the aspiration at the emitter means generates a negative pressure in said time delay conduit means, and including means for draining liquid from the time delay conduit means and the emitter means.

17. The apparatus of claim 15, including second fluid amplifier means in communication with the control means of said first named fluid amplifier means for controlling the same.

18. The apparatus of claim 14, including reservoir means for collecting the liquid directed from said time delay conduit means and the liquid diverted from said emitter means.

19. The apparatus of claim 18 wherein said supply means includes means for drawing liquid from said reservoir means.

20. The apparatus of claim 18, including means for draining liquid from said emitter means and said time delay conduit means into said reservoir.

21. The apparatus of claim 14, including inlet restriction means at the entrance of said time delay conduit means.

22. The apparatus of claim 14, including restriction means at the outlet of said time delay conduit means for generating a jet of liquid against the stream of liquid dispensed by the emitter means.

23. The apparatus of claim 14, including trap means in said time delay conduit means for capturing any air entrapped in the conduit means.

24. The apparatus of claim 14 wherein said supply means includes means for pulsating the feeding of liquid under pressure to said emitter means.

25. The apparatus of claim 24, including means for draining liquid from said time delay conduit means between pulsations of liquid to said emitter means.

* * * * *